US007839724B2

(12) United States Patent
Schmiedchen et al.

(10) Patent No.: US 7,839,724 B2
(45) Date of Patent: Nov. 23, 2010

(54) DRIVE MECHANISM FOR A TIMEPIECE CALENDAR DATE DISPLAY

(75) Inventors: Christian Schmiedchen, Reichstädt (DE); Jürgen Franke, Pirna (DE)

(73) Assignee: Glashütter Uhrenbetrieb GmbH, Glashütte/Sachsen (DE)

( * ) Notice: Subject to any disclaimer, the term of this patent is extended or adjusted under 35 U.S.C. 154(b) by 382 days.

(21) Appl. No.: 12/092,606

(22) PCT Filed: Dec. 5, 2006

(86) PCT No.: PCT/EP2006/069305

§ 371 (c)(1),
(2), (4) Date: May 5, 2008

(87) PCT Pub. No.: WO2007/065889

PCT Pub. Date: Jun. 14, 2007

(65) Prior Publication Data

US 2008/0279049 A1 Nov. 13, 2008

(30) Foreign Application Priority Data

Dec. 9, 2005 (EP) ..... 05111919

(51) Int. Cl.
*G04B 19/24* (2006.01)

(52) U.S. Cl. ..... 368/37

(58) Field of Classification Search ..... 368/28, 368/34–38

See application file for complete search history.

(56) References Cited

U.S. PATENT DOCUMENTS

| | | | | |
|---|---|---|---|---|
| 3,082,594 A | 3/1963 | Stamm et al. | | |
| 5,379,272 A * | 1/1995 | Parmigiani | ..... | 368/37 |
| 5,699,321 A * | 12/1997 | Vaucher | ..... | 368/37 |
| 6,108,278 A * | 8/2000 | Rochat | ..... | 368/28 |
| 7,280,437 B2 * | 10/2007 | Rochat | ..... | 368/37 |
| 2005/0232085 A1 * | 10/2005 | Scheufele | ..... | 368/37 |
| 2006/0221773 A1 * | 10/2006 | Kuepfer et al. | ..... | 368/37 |

FOREIGN PATENT DOCUMENTS

| | | |
|---|---|---|
| CH | 338766 | 5/1959 |
| CH | 395871 | 3/1965 |
| EP | 1 070 996 A1 | 1/2001 |
| GB | 1 186 081 | 4/1970 |
| WO | 01/77756 A1 | 10/2001 |

OTHER PUBLICATIONS

International Search Report issued in corresponding application No. PCT/EP2006/069305.

* cited by examiner

*Primary Examiner*—Vit W Miska
(74) *Attorney, Agent, or Firm*—Griffin & Szipl, P.C.

(57) ABSTRACT

A calendar date display comprises a ten-day indicator (2) and a unit indicator (1) driven by a program drive (8), which is provided with a calendar date display (9) whose toothing is engaged with the beak (15) of a lever (16) in such a way that a wheel is moved one step forward by one date number change. Between each calendar number change, the beak (15) is engaged between the first and second teeth (11, 12) of the wheel (9). At the time of the calendar number change, the beak (15) is disengaged from said first and second teeth (11, 12) in such a way that it is engaged between the second and third (12, 13) teeth of the wheel (9), thereby moving said wheel one step forward.

6 Claims, 4 Drawing Sheets

DRIVE MECHANISM FOR A TIMEPIECE CALENDAR DATE DISPLAY

This is a national Phase Application in the United States of International Patent Application No. PCT/EP2006/069305 filed Dec. 5, 2006, which claims priority on European Patent Application No. 05111919.6, filed Dec. 9, 2005. The entire disclosures of the above patent applications are hereby incorporated by reference.

FIELD OF THE INVENTION

The present invention relates to a drive mechanism for a day of the month display for a timepiece comprising a first indicator and a second indicator on which Figures are affixed respectively indicating the units and tens of said day of the month, these indicators being driven by a program wheel set. The latter bears a day of the month wheel comprising thirty one teeth, this wheel being in turn driven by the beak of a lever so as to be moved one step forward by one calendar number change.

BACKGROUND OF THE INVENTION

The mechanism described briefly in the paragraph above is well-known in the art. This mechanism is fitted to a timepiece, called a large date timepiece where the day of month appears through a large aperture arranged in the timepiece dial. The date then appears in larger dimensions than if it were printed on a single ring making one revolution less and moving by approximately 11.5 degrees per day.

The first and second indicators respectively indicating the units and tens of the day of the month are driven by a program wheel set which is described in document WO 01/77756. This wheel set is arranged to drive the first indicator at the end of every day by one step except at the end of the thirty first day when it is not driven, and the second indicator by one step at the end of the ninth, nineteenth, twenty-ninth and thirty first days of the month.

This program wheel set carries a day of the month wheel having thirty one teeth which is driven in a known manner by the beak of a lever controlled in turn either by the drive mechanism of the timepiece, or by a manually actuated pusher when a need to correct of the date is felt. In both cases, the change of date takes place when the beak of the lever—controlled manually or by the driving mechanism—penetrates between two teeth of the day of the month wheel and causes the latter to advance by one step.

Once the function is completed and due to the effect of a return spring acting on the lever, the beak is extracted from the wheel toothing.

This constructive arrangement has a major disadvantage, that of the risk of one of the indicators racing. Indeed, as the correction of the date is carried out by means of a pusher and as the force exerted manually on this pusher is not constant but depends on the strength with which the latter is pushed, the day of the month wheel and with it the program wheel set which is connected thereto can drive either the tens indicator, or the units indicator, as a result of said indicators, own inertia beyond the desired swing angle of a single step, consequently a progression of two units or only one unit can occur. For the tens indicator this danger exists if a correction is made the ninth, nineteenth, twenty-ninth and thirty-first day of the month and for the units indicator if a correction is made the thirtieth day of the month. This necessarily results in a loss of synchronization between the two indicators, and this synchronization can be restored only by opening the timepiece to restore order.

To avoid the disadvantages described in the paragraph above, at least at the time of the passage from the twenty-ninth to the thirtieth then from the thirtieth to the first day of the next month, document WO 01/77756 cited above implements a ratchet and two pins which prevent from one or other of the indicators racing. This system is relatively complicated and requires additional parts thus increasing the price of the timepiece.

SUMMARY OF THE INVENTION

The present invention prevents from one or other of the indicators racing whatever the date of the change of day of the month and without it being necessary to add any additional parts to the timepiece. In order to do so, day of the month display the drive mechanism, and in addition to answering the description of the first paragraph of this description the drive mechanism is characterized in that between each change of day of the month the beak of the lever is engaged between first and second teeth of the day of the month wheel and in that at the time of the change of day of the month said beak is initially disengaged from said first and second teeth to fall then between second and third teeth of said wheel and thereby drives said wheel forward by one step.

BRIEF DESCRIPTION OF THE DRAWINGS

The invention will now be described in detail based on the following description which is illustrated by the annexed drawings given by way of example of one embodiment and in which.

DETAILED DESCRIPTION OF THE ILLUSTRATIVE EMBODIMENTS

Figure 1:
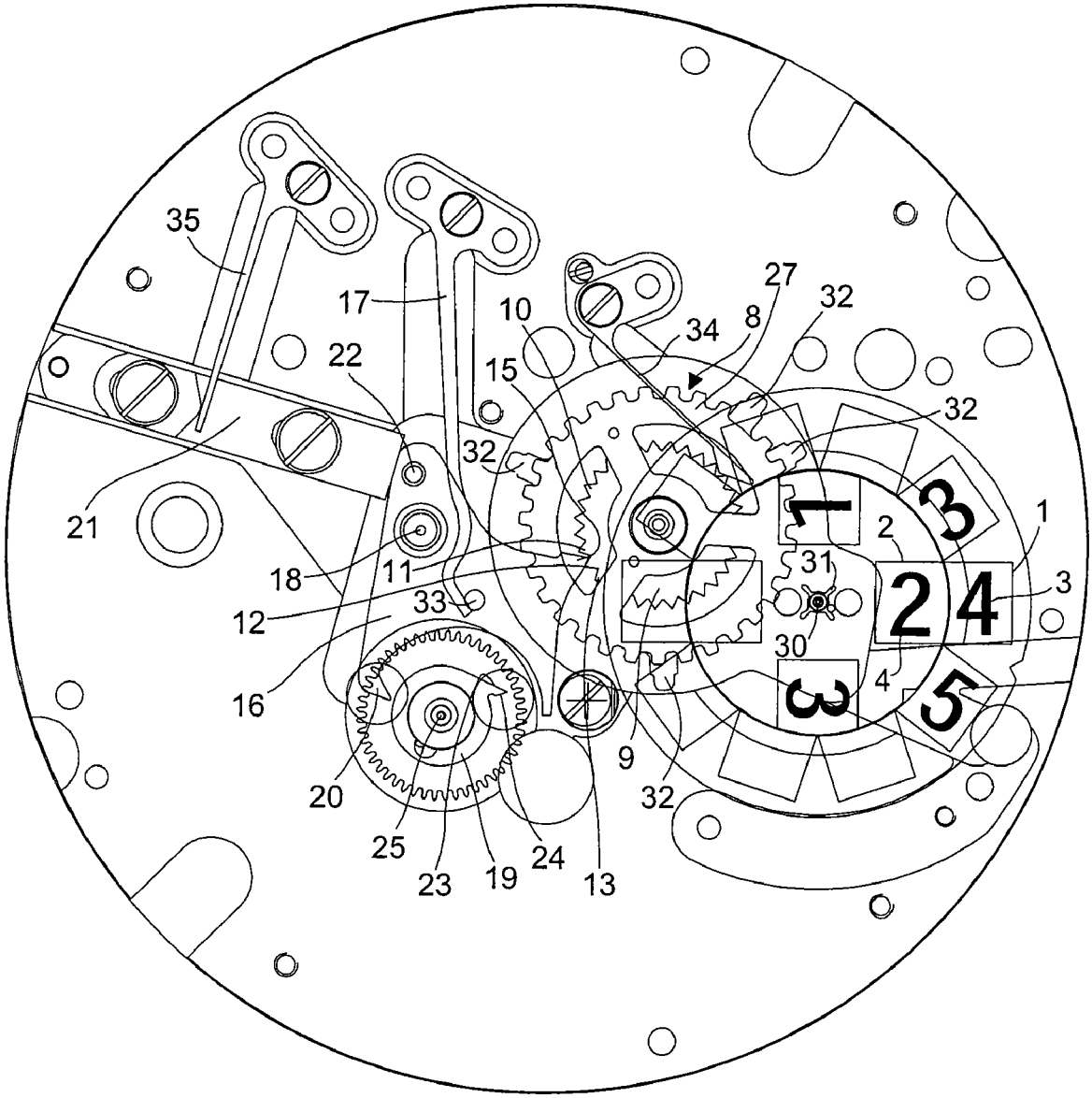
FIG. 1 shows the mechanism according to the invention in its configuration between each change of day of the month.

The day of the month display drive mechanism is illustrated in the Figures enumerated above. This day of the month display comprises two indicators. The first indicator 1 displays the units 3 of the day of the month and the second indicator 2 displays the tens 4 of said day of the month. Indicators 1 and 2 are mounted coaxially to each other, that of the tens being mounted inside that of the units. The date appears through a large aperture arranged in the dial of the timepiece, indicators 1 and 2 being driven by a program wheel set P.

Figure 3:
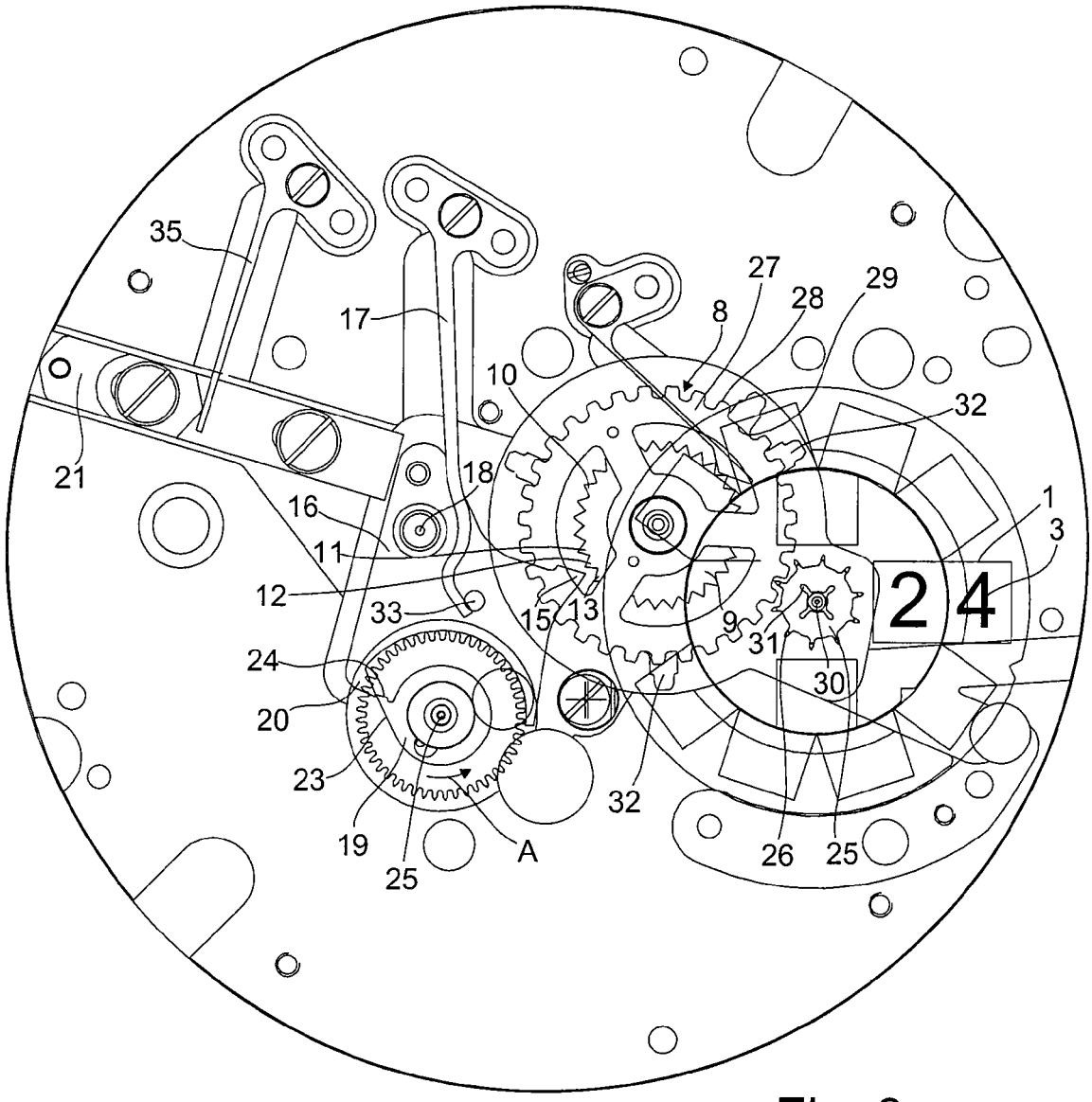
FIG. 3 shows the mechanism according to the invention in its configuration at the beginning of a change of day of the month due to an action exerted by the timepiece movement.
Figure 4:
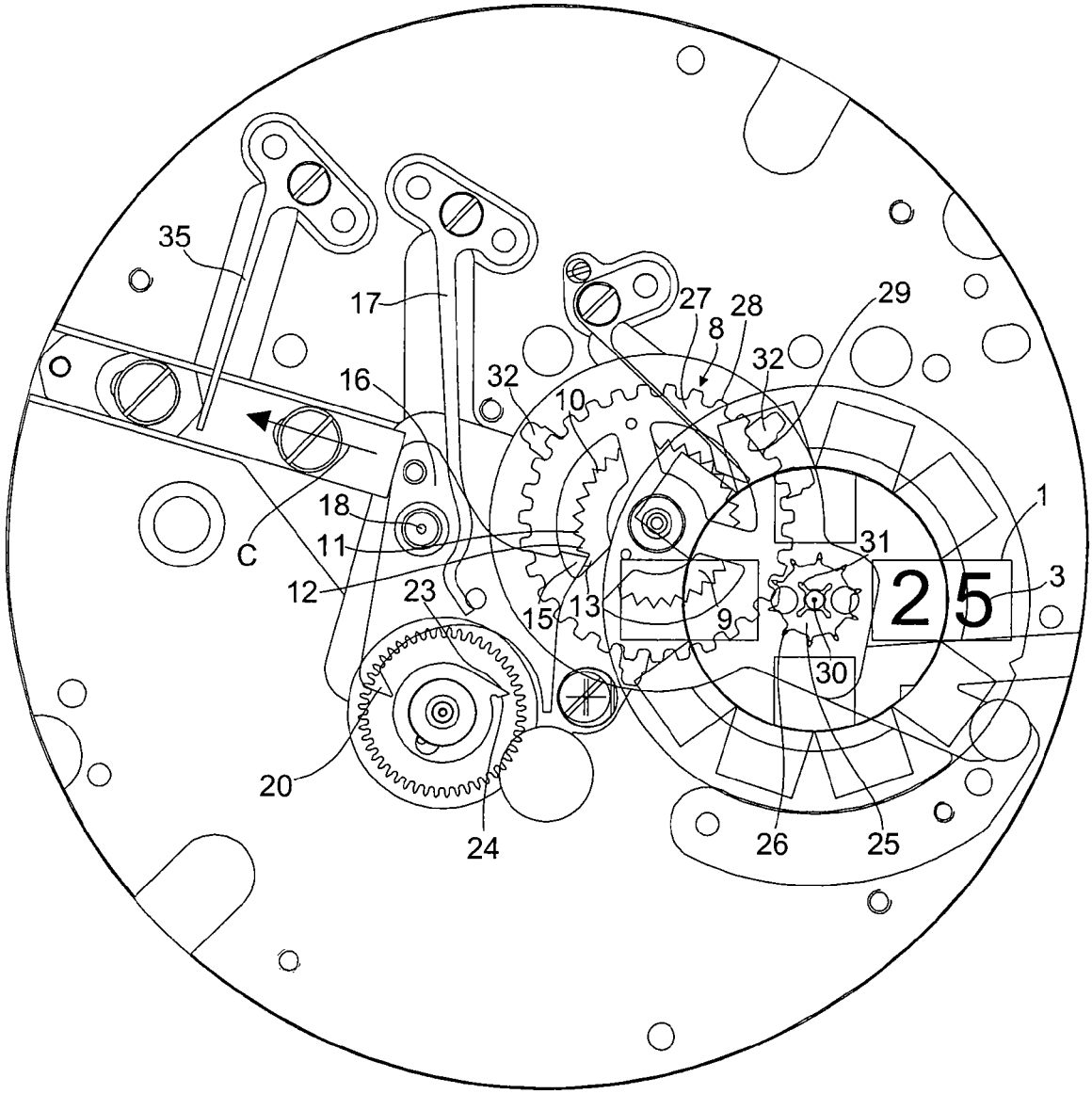
FIG. 4 shows the mechanism according to the invention in its configuration at the end of each change of day of the month.

The program wheel set 8 drives first indicator 1 of the units 3 by one step at the end of every day except at the end of the thirty-first day when it is not driven. Thus FIGS. 3 and 4 show that unit indicator 1 is provided with a star 25 having ten branches 26 meshing with a wheel 27 having thirty teeth 28, the latter being secured to the program wheel set P. Wheel 27 has a space 29 with no teeth so that indicator 1 of units 3 is not driven when the date passes from the $31^{st}$ of the month that is ending to the first of the following month, the number 1 remaining immobile and thus being used for both dates.

Program wheel set 8 is also arranged to drive second indicator 2 of tens 4 by one step at the end of the ninth, nineteenth, twenty ninth and thirty first days of the month. Thus, the Figures show that indicator 2 of tens 4 is provided with a pinion 30 having four branches 31 meshing with one of the four projecting parts 32 fixed to program wheel set 8, these projecting parts being arranged on wheel set 8 to drive indicator 2 of tens 4 forward by one step at the end of the days referred to above.

The Figures also show that program wheel set 8 carries a day of the month wheel 9 having thirty one teeth 10 regularly distributed around wheel 9. This day of the month wheel 9 is driven in turn by the beak 15 of a lever 16. In the embodiment shown in the drawings, a return spring 17 acts on lever 16, the latter pivoting about an axis 18.

FIG. 1 shows the driving mechanism in its configuration between each change of day of the month. It is the rest position according to the original idea which makes present the invention, beak 15 of lever 16 is then engaged between first and second teeth 11 and 12 of the day of the month wheel 9. This arrangement has a first obvious advantage, which is to block the mechanism and thereby make it insensitive to possible shocks exerted on the timepiece, which could inadvertently rotate the day of the month wheel between the change of date periods. This arrangement thus deviates from that generally adopted in the prior art which consists in releasing the beak of the toothing of wheel 9, the insensitivity to shocks being assured only by one jumper spring 34 acting on the toothing. The engagement of beak 15 in the toothing of the day of the month wheel is ensured by the force of a return spring 17 which presses on lever 16. As shown in FIG. 1, the displayed date is the $24^{th}$.

Figure 2:
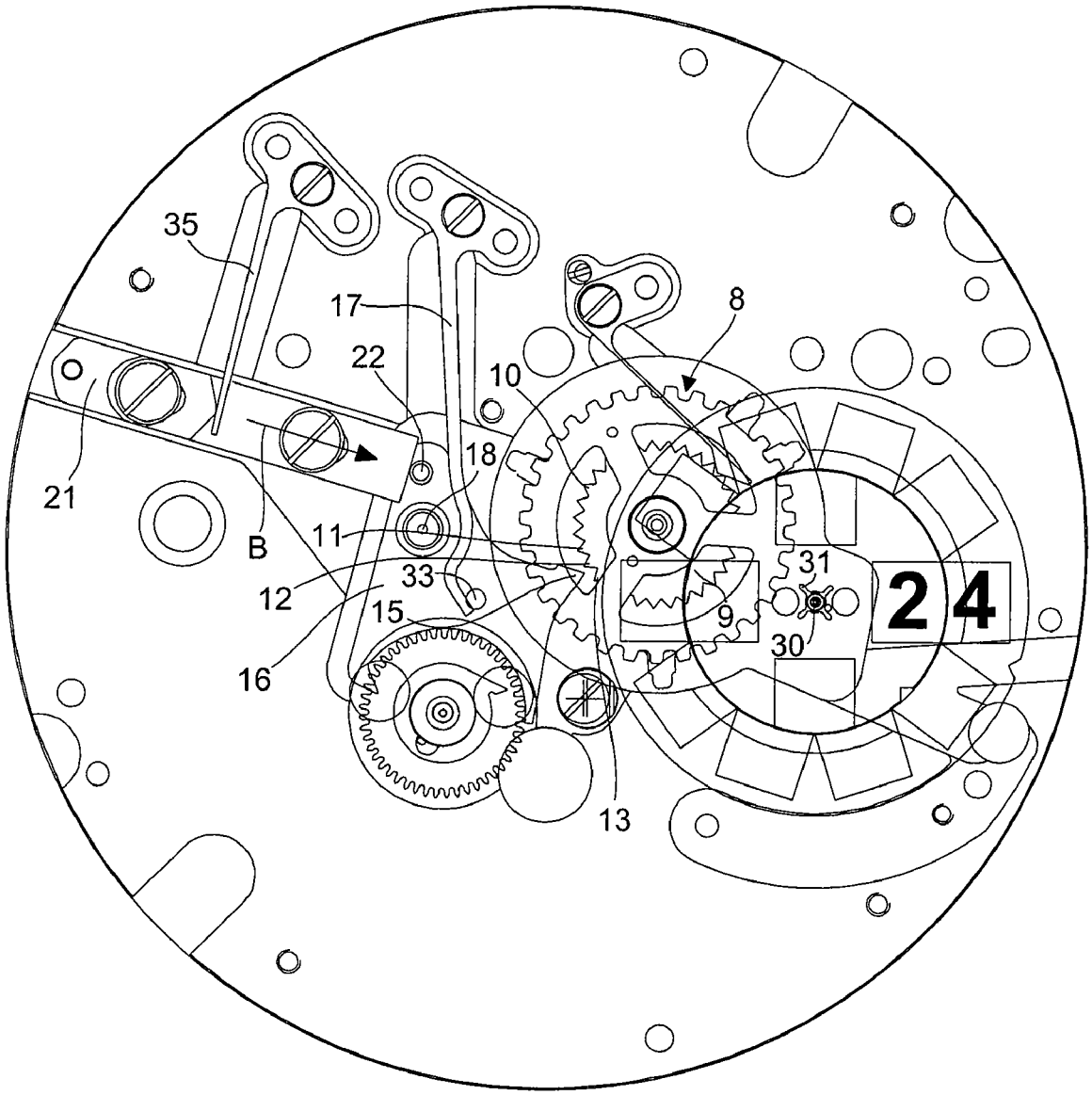
FIG. 2 shows the mechanism according to the invention in its configuration at the beginning of a change of day of the month due to an action exerted on a correction pusher.

FIG. 2 shows the driving mechanism in its configuration at the beginning of a change of day of the month due to an action exerted on a correction pusher. In this Figure, the pusher itself is not shown, but a stem 21 which is associated thereto. This stem is biased by a spring 35. FIG. 2 shows that beak 15 of lever 16 is disengaged manually from the day of the month wheel 9 to correct the date. This release is carried out by means of stem 21 of the pusher. Stem 21 cooperates with a driving pin 22 mounted on lever 16 and makes this lever rotate clockwise when stem 21 moves in the direction of the arrow B via manual action exerted on the pusher associated with this stem. At this moments beak 15 of lever 16 is thus disengaged from first and second teeth 11 and 12 and is presented opposite second and third teeth 12 and 13 of the day of the month wheel 9. As shown in FIG. 2, the displayed date is still the $24^{th}$.

FIG. 3 shows the driving mechanism in its configuration at the beginning of a change of day of the month due to an action exerted by the timepiece movement. This is a change of day of the month such as it occurs at the end of each day. Here beak 15 of lever 16 is disengaged from the day of the month wheel 9 by a cam 19 driven by the timepiece movement, this cam 19 making a revolution in twenty-four hours while turning in the direction of arrow A and cooperates with a finger 20 with which lever 16 is provided. As in the preceding case, the beak of the lever is disengaged from the first and second teeth 11 and 12 and is presented opposite the second and third teeth 12 and 13 of the day of the month wheel 9. As shown in FIG. 3, the displayed date is still the $24^{th}$.

FIG. 3 still shows that cam 19 has a first rising sector 23 with a small inclination. As cam 19 is rotating in the direction of arrow A, finger 20 of lever 16 starts by climbing this first sector 23, thereby rotating lever 16 clockwise to release its beak 15 from the toothing of the day of the month wheel 9. As shown in FIG. 3, the release is maximum when the top of finger 20 reaches the end of the first sector 23.

FIG. 4 shows the driving mechanism in its configuration at the end of the change of day of the month. FIG. 4 shows that beak 15 has fallen between the second and third teeth 12 and 13 of the day of the month wheel 9, which has made this wheel rotate clockwise and indicator 1 of the units 3 advance by one step, said indicator having then passed from the 4 to the 5, the displayed date having passed from the $24^{th}$ to the $25^{th}$. The change of day of the month was caused either manually by releasing the pressure exerted on the pusher, or mechanically by the timepiece movement at the end of a day.

FIG. 4 shows that stem 21 has returned to its rest position in the direction of the arrow C by releasing the manual pressure exerted on its pusher, this return being effected by the return spring 35. At this moment, biased by spring 17, lever 16 rotates in an anti-clockwise direction and its beak 15 lodges between second and third teeth 12 and 13 of wheel 9, thereby rotating this wheel by one step as described above.

Thus the change of day of the month by the correction pusher takes place not when this pusher is pressed, but when this pusher is released. This is the core of the invention i.e. the actuation force exerted on the day of the month wheel to drive it forward by one step only results from return spring 17 and no longer from the manual force exerted on the pusher. This manual force is not controllable and therefore not constant, whereas the force of a spring is perfectly constant and adjustable. As explained in the introduction of this description, the manual force exerted on the pusher can cause one or other of the indicators to race during a date correction and desynchronize one indicator with respect to the other, which means that the timepiece will have to be opened to restore this synchronization. According to the present invention, indicator racing is not possible since the force exerted by the return spring on the lever to achieve the change the day of the month is perfectly controllable and adjustable to prevent any possible racing.

FIG. 3 also shows that cam 19 has a second descending sector 24 arranged substantially radially with respect to the axis of rotation 25 of the cam. The second sector 24 has an empty space in which finger 20 falls as soon as the cam continues to rotate in the direction of arrow A, i.e. at the moment of the day of the month change. The drop of finger 20 into the empty space of the cam causes lever 16 to rotate instantaneously in an anti-clockwise direction and causes beak 15 to penetrate between second and third teeth 12 and 13, thereby causing the instantaneous forward movement of the day of the month wheel and therefore, the instantaneous change of one or other of the indicators. The instantaneous passage of the day of the month at midnight has not been proposed yet, to the knowledge of the applicant, in large date display timepieces comprising trailing or semi-instantaneous mechanisms which require several tens of minutes to pass from one date to the other.

The invention claimed is:

1. A drive mechanism for a day of the month display of a timepiece, this day of the month display comprising first and second indicators on which figures are affixed respectively indicating the units and the tens of said day of the month, these indicators being driven by a program wheel set, said program wheel set itself carrying a day of the month wheel having thirty one teeth, this day of the month wheel being driven in turn by the beak of a lever to make said day of the month wheel move forward by one step during a change of day of the month, wherein the beak of the lever is engaged between first and second teeth of the day of the month wheel and wherein at the time of the day of the month change, said beak is initially disengaged from said first and second teeth to fall then between the second and third teeth of said wheel and thereby make said day of the month wheel move forward by one step.

2. The mechanism according to claim 1, wherein the program wheel set is arranged to drive the first indicator by one step at the end of every day except at the end of the thirty-first day when it is not driven, and the second indicator by one step at the end of the ninth, nineteenth, twenty-ninth and thirty-first days of the month.

3. The mechanism according to claim 1, wherein the lever pivots about an axis and wherein between each day of the month change, the beak of this lever is engaged and maintained between two teeth of the day of the month wheel by the force of a return spring pressing on said lever.

4. The mechanism according to claim 3, wherein the beak of the lever is disengaged from the day of the month wheel at the end of each day by a cam driven by the timepiece movement, this cam cooperating with a finger with which the lever is provided to make the day of the month wheel move forward by one step.

5. The mechanism according to claim 4, wherein the cam has a first rising sector having a small inclination climbed by the finger of the lever before the day of the month change and a second descending sector arranged substantially radially with respect to the axis of rotation of the cam, this second sector having an empty space in which said finger falls at the time of the day of the month change to rotate said lever, said lever moving the day of the month wheel forward instantaneously by one step.

6. The mechanism according to claim 3, wherein the beak of the lever is able to be disengaged manually from the day of the month wheel to correct the date displayed by the timepiece, by means of a pusher, this pusher cooperating with a pin with which the lever is provided to move the day of the month wheel forward by one step.

* * * * *